United States Patent [19]

Godfrey et al.

[11] 4,039,030

[45] Aug. 2, 1977

[54] OIL AND GAS WELL STIMULATION

[75] Inventors: Charles S. Godfrey; E. T. Moore, Jr., both of Berkeley; Douglas M. Mumma, Livermore, all of Calif.

[73] Assignee: Physics International Company, San Leandro, Calif.

[21] Appl. No.: 700,094

[22] Filed: June 28, 1976

[51] Int. Cl.[2] ..... E21B 43/26

[52] U.S. Cl. ..... 166/299; 166/63; 166/177; 166/250; 166/308

[58] Field of Search ..... 166/299, 250, 259, 271, 166/308, 63, 177; 239/177

[56] References Cited

U.S. PATENT DOCUMENTS

| | | | |
|---|---|---|---|
| 3,002,454 | 10/1961 | Chestnut | 166/299 |
| 3,029,732 | 4/1962 | Greene | 166/63 X |
| 3,101,117 | 8/1963 | Scott et al. | 166/63 X |
| 3,630,284 | 12/1971 | Fast et al. | 166/299 |
| 3,848,674 | 11/1974 | McColl et al. | 166/63 X |

*Primary Examiner*—Stephen J. Novosad

*Assistant Examiner*—George A. Suchfield

*Attorney, Agent, or Firm*—Lindenberg, Freilich

[57] ABSTRACT

A method and means for stimulating oil and gas wells to increase production comprises filling a well above the pay zone level with a fracturing fluid, then suspending a cylinder of high explosive centrally within the well-bore adjacent to the pay zone. Thereafter a propellant is suspended within tens of feet above the high explosive and the well above the propellant is enclosed. The application of high explosive is chosen to cause multiple radiating fractures but will not crush the rock in the well. Also, the rise time of the shock wave created by the explosive should be less than the time required for sound to traverse one-half of the periphery of the well opening in the rock at the pay zone. The propellant is detonated first, followed by the detonation of the high explosive. The purpose of using the propellant is to maintain pressure caused by the high explosive over a longer period, thereby extending the fractures caused by the high explosive.

12 Claims, 4 Drawing Figures

OIL AND GAS WELL STIMULATION

BACKGROUND OF THE INVENTION

This invention relates to the method and means for stimulating wells by injecting fluid in response to the detonation of a high explosive.

In an application ser. no. 250,184 by Charles S. Godfrey, filed May 4, 1972, now abandoned, which is assigned to a common assignee, there is described a method and means for fracturing the rock formation in a well at a predetermined depth in the well. The reason for causing these fractures is to stimulate these wells to increase the flow rate of gas or oil. If these fractures can be formed in a manner to radiate in all directions from the wellbore, then there is a good likelihood for oil or gas to flow into the fractures and to the wellbore. The aforementioned application describes a technique for fracturing the rock formation, which includes generating a detonation which applies a shock wave to the fracturing fluid, which has a rise time which is less than the time required for sound to traverse one-half of the periphery of the wellbore, and the amplitude of the shockwave should be less than the amount which will crush the rock formation.

The reason for the requirement that the shock wave rise time be so rapid is because this is what sets up a rapid rise time stress wave in the rock formation, which causes multiple radial fractures. With a slow rise time stress wave, such as is produced by a mechanical pump or deflagration of a propellent type of explosive, a single fracture through the borehole would relieve the stress to the extent that no more fractures can occur. With a fast rise stress wave, full stress is applied to the rock strata around the hole before a single fracture can occur to relieve the stress and thus multiple radial fractures can be caused to occur rather than one.

After a fracture has been created, it is desirable that that fracture extend as deeply as possible in order to reach the producing region surrounding a wellbore. In order to extend a fracture there must be a source of energy applying pressure to the fluid driven by the initial detonation into the fracture caused thereby. Accordingly, if it were possible to provide a detonation having the indicated rise time and amplitude to cause a plurality of radial fractures in the pay zone, and to thereafter maintain the pressure required to extend the fractures over an interval which is long when compared to the interval, normally in microseconds, over which the detonation pressure exists, radial fractures can be extended considerably more with a greater likelihood for a pay off.

OBJECTS AND SUMMARY OF THE INVENTION

It is an object of this invention to provide a method and means using an explosive to generate multiple fractures without crushing the borehole and for maintaining the pressure created by a detonation over a considerably longer period than has been done before.

Yet another object of the present invention is to provide a novel method and means for gas and oil well stimulation.

Still another object of the invention is the provision of a novel method and means for extending the fractures in a well, created by a detonation.

The foreoing and other objects of the invention may be achieved by first filling the well above the pay zone with a fluid, which can contain a propping agent, such as sand. Thereafter, there is lowered into the fluid adjacent to the pay zone a cylinder of explosive having a length as long as a pay zone which is the region where fractures are desired to be created and having a diameter such that when detonated the amplitude of the explosion will be less than that required to crush the rock. The explosive should have a rise time, as previously indicated, which will create a stress wave in the rock having a rise time which is faster than the time required for sound to travel through one-half of the hole periphery of the rock strata which is being fractured. It has been found that the explosive diameter which is on the order of 1/7 to 1/8 of the wellbore diameter in a fluid filled pay zone usually meets this requirement.

In the fracturing fluid, above the high explosive, there is suspended a propellant. This well is sealed immediately above the propellant. The distance between the explosive and propellant depends on the pay zone thickness and desired fracture length. Assuming that the fluid is displaced into the multiple fractures, the volume of fluid contained between the explosive and propellant should equal or exceed the desired fracture volume. For example, to create five fractures, each 100 feet long and 1/8 inch wide in a 10-foot-thick production zone, would require 74 feet of 8-inch borehole between high explosive and propellant. The propellant has a slow rise time and it is ignited first. The quantity of propellant is selected to produce pressures on the order of those required for propagating a fracture,, once a fracture has been started. After the propellant has been ignited, it generates a gas which applies pressure to the fluid. This pressure is maintained for a considerably longer period than can be had, if initiated by a high explosive detonation. Accordingly, shortly after the propellant has been ignited, the explosive applies pressure to the surrounding fluid such that multiple fractures are generated in the pay zone, and because of the pressure still being applied as a result of the deflagration of the propellant, the fractures caused by the explosives are extended considerably beyond what they would otherwise be. Because of the concentration of stress at the tip of a fracture, less pressure is needed to continue the propagation of the fracture than is required to initiate the fracture.

The novel features of the invention are set forth with particularity in the appended claims. The invention will best be understood from the following description when read in conjunction with the accompanying drawings.

DESCRIPTION OF THE PREFERRED EMBODIMENS

Figure 1:
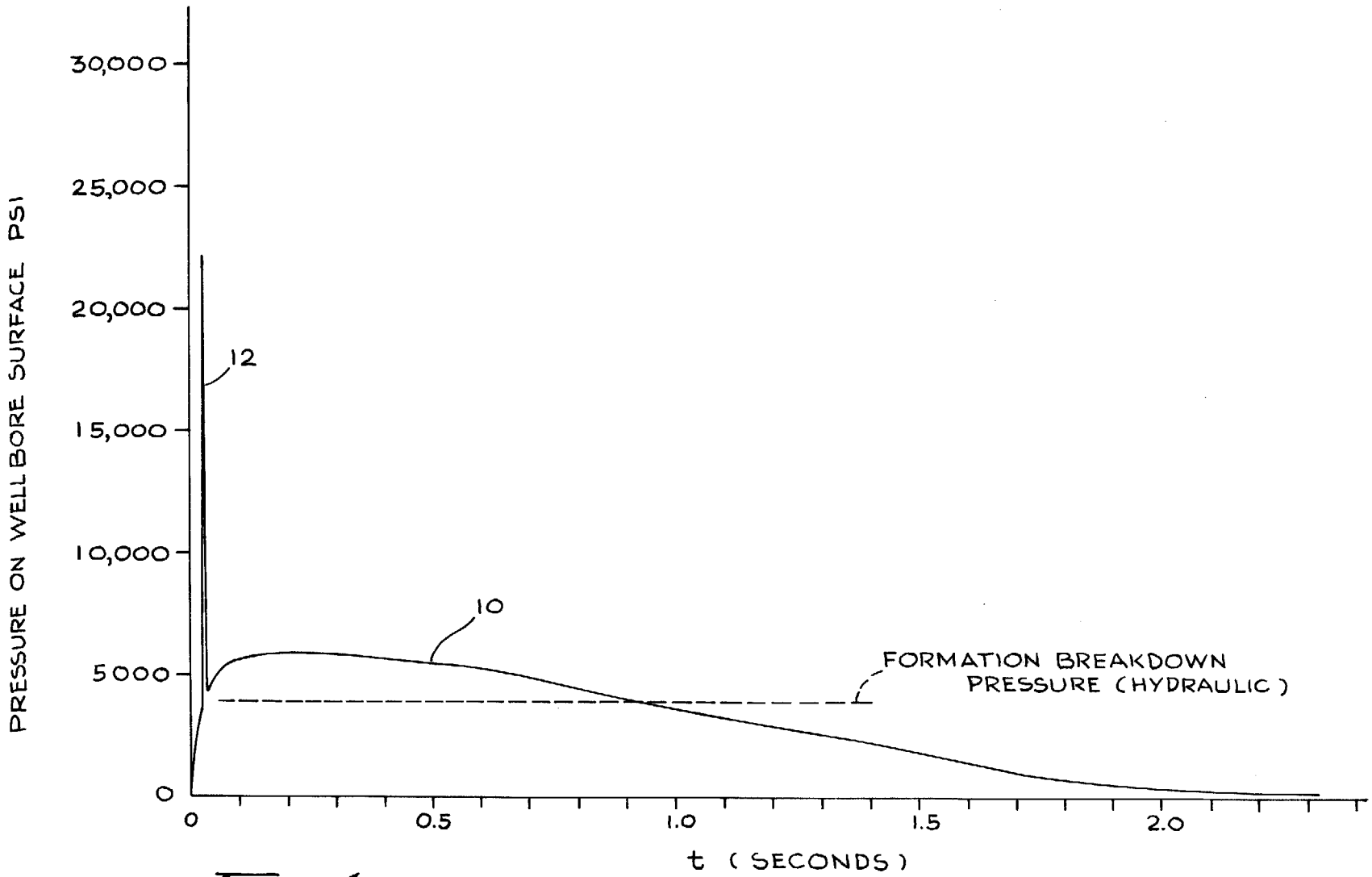
FIG. 1 is a waveshape drawing illustrating the super positioning of a detonation pressure wave from the explosive onto the deflagration pressure wave from the propellant.

Referring now to FIG. 1, waveform 10 represents the variation of pressure versus time of the pressure wave generated in the borehole by the ignition of a propellant, theamount of fluid in the borehole and the rate at which the fluid is displaced into the formation. Care must be taken to assure that the pressure generated by the propellant does not reach or exceed the pressure that will cause the formation to fracture into a single fracture before the initiation of the explosive. It will be seen that the pressure rises relatively slowly to its maximum at which it stays for a period of time, depending upon the type and quantity of the propellant. Superimposed thereon is a pressure versus time wave 12, of an explosive detonation. This has a short and sharp rise time and fall time. As indicated previously, the detonation will reach its peak within the time required for the sound wave to traverse through one-half of the rock formation adjacent to detonation. The amplitude of the pressure wave should be sufficiently high to fracture the particular kind of rock but not to crush it, and a rise time sufficient to cause multiple fractures.

Once the fractures have been created, in order to cause them to continue propagating, it is necessary to maintain the stress on the rock formation in the fractures. It has been found that because of stress concentrations at the tip of the fracture, it takes less pressure to propagate a fracture than to initiate one. However, a fracture propagates through a rock at a certain velocity. The maximum velocity of crack propagation in typical rocks has been determined to be on the order of 5000 feet per second. Since the pressure is applied to the rock formation through the vehicle of the fluid, it is desirable to be able to pump the fluid into the fracture at the velocity of rock fracture propagation and with the requisite pressure for continuing the fracturing process. A crack generally cannot propagate more than a few feet when driven solely by reasonable amounts of high explosives because the pressure created by the high explosives drops so rapidly.

In accordance with this invention, the high explosive is used to generate a plurality of cracks in the pay zone. Once these cracks are formed, a pressure required for their propagation is maintained by the pressure produced by the ignition of the propellant. It is ignited before the explosive is detonated so that it will rise up to a predetermined pressure by the time the initial rock fractures have been created.

Figure 2:
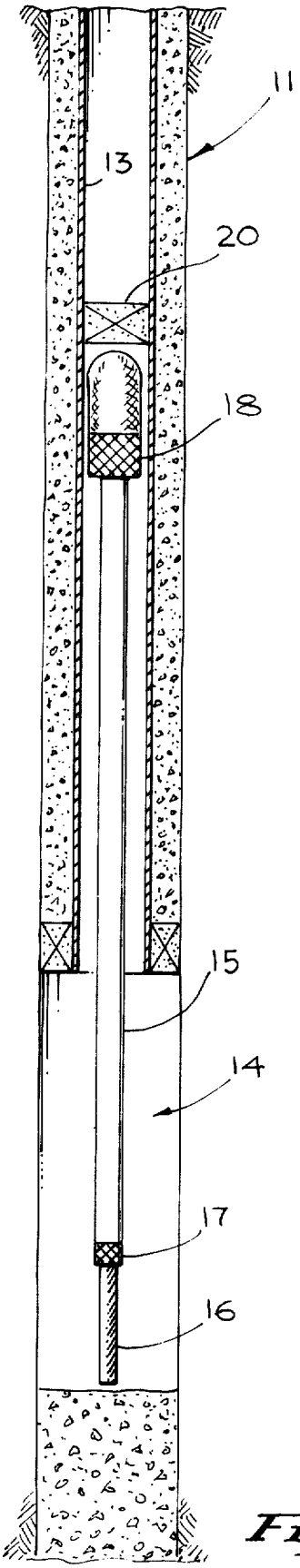
FIG. 2 is a cross sectional schematic of an embodiment of this invention.

FIG. 2 is a cross section of a section of the well adjacent the pay zone showing the well stimulation apparatus in accordance with this invention. The well 11 will have a well casing 13 which ends above the pay zone 14, which is the region where fracturing or radiating cracks is desired, in order to stimulate the well. In accordance with this invention, if casing exists in the region in which it is desired to generate holes it is first necessary to fracture the casing. Techniques for doing this are well-known.

A fluid such as oil, kerosense, or water is used to couple th explosive to be used to the formation. Accordingly, the bore hole is filled above the pay zone with the coupling fluid. Thereafter, a cylinder of high explosive 16 is suspended by suitable means 15, at the center of the bore hole. Adjacent the cylinder is a container 17 holding timing and firing means for the high explosive. The length of the cylinder is usually determined as the region of the pay zone over which it is desired to propagate fractures. The chylinder length taken together with its diameter determines the quantity of high explosive which must be used. As previously indicated it is desired to use that quantity of explosive which will provide a peak pressure wave which will not crush the rock formation but will merely fracture it. It has been found that a diameter on the average of 1/7 to ⅛ of the bore hole diameter can provide the desired shock wave.

Suspended above the high explosive 16 is a propellant 18. As previously indicated, the distance between the explosive and propellant depends to a great extent on the volume of fluid required to be propelled into the fractures which are to be created. Immediately above the propellant, the well is sealed by a suitable cover 20 such as a bridge plug, gravel pack or cement. Water is often introduced above this cover as an inertial tamp.

The quantity and type of propellant used is one which will provide a pressure wave of sufficient intensity and duration so that the fluid between the propellant and explosive is forced to enter the fracture create by the high explosive and to follow the fracture extension with a velocity that equals or exceeds the propagation velocity of the fracture through the rock. Then there must be taken into consideration the number of fractures estimated to be produced as a result of the detonation to determine the quantity of fluid which must be displaced. For example, it has been estimated that the time required to drive a crack 20 feet into an oil or gas bearing sandstone would be on the order of 4.8 milliseconds. Assuming that the height of the fracture is 10 feet and the width of the fractures at the wellbore is on the order of 1/16 of an inch, a total volume of 39 gallons has to be displaced into 5 vertical fractures. If the fractures were indeed propagating at a terminal velocity of 0.125 centimeters per microseconds, this requires a propellent source capable of displacing fluid at a maximum rate of 8125 gallons per second. Solid propellants capable of doing this are known. One of these is known as a double-based propellant called N-5. It contains nitroglycerine and nitrocellulose. Another suitable propellant is a composite propelland which contains ammonium perchlorate in a rubberized binder. The composite propellant is known as HXP-100 and is purchaseable from the Holex Corporation of Hollister, California.

The gas evolution rate of the propellant is determined by the surface area that is burning and the burning rate of the propellant at the pressure of the sealed well. Also, the duration of the burn is directly related to the burn rate and the thickness of the propellant that is allowed to burn. These parameters are known to those skilled in the art as well as how to control them for the purpose of generating gas at a substantially constant pressure for a predetermined interval of time.

After the propellant has been ignited and before it reaches its maximum gas generation rate, one end of the explosive cylinder is ignited. This is done usually through the suspending wires to carry the ignition signal to the timing and firing box in a manner known to those skilled in the art. The detonation wave propagates down the cylinder with a velocity equal to the detonation velocity of the explosive used. The high pressure behind the detonation wave causes strong shock waves to be generated in the fluid. As the shock wave encounters the higher impedance formation of the rock it is transmitted into the formation and also reflected back into the fluid. As the transmitted shock wave moves into the formation, tangential stresses are produced on the inside wall of the bore hole. As previously indicated, the type of explosive and diameter of the explosive cylinder are chosen such that the stresses of the bore hole wall do not cause crushing to occur in the formation. Since the tangential stresses are considerably above the tensile stress of the formation, the bore hole begins to yield in tension and the stress application at the wall is sufficiently fast to cause multiple fractures to occur. As the fractures begin to open, the fluid is pushed into the fractures by the residual pressure of the hot explosive products.

Since, as shown in FIG. 1, the detonation pressure wave subsides very rapidly, the pressure created by the propellants sustains the pressure caused by the detonation with the result that the fractures which have been created by the detonation of the explosive are extended deeper into the reservoir and thereby can increase the productivity of the well.

Figure 3:
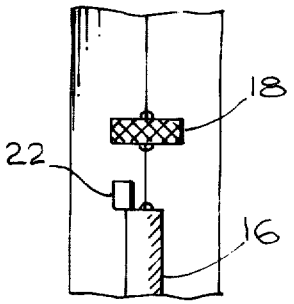
FIG. 3 illustrates schematically another arrangement for this invention.

It has been explained that the propellant is first ignited and thereafter the high explosive is ignited. One technique is to connect wires to both of these whereby an electrical timer can be triggered upon the initiation of the firing of the propellant so that following a suitable interval it thereafter ignites the explosive. Another technique is schematically represented in FIG. 3. Here, a pressure sensitive capsule 22, is positioned at one end of the explosive. When the pressure resulting from the deflagration of the propellant 18 attains a predetermined level, at the location of the explosive which is the one best suited for extending the fractures created by the explosive's detonation, the pressure sensitive capsule 22 is triggered and ignites the high explosive 16. Capsules which can ignite an explosive in response to a predetermined pressure are well known in the art.

There exists a wide variety of explosives that may be used for the purpose indicated. The explosive could be solid, plastic, liquid or slurries. The primary requirements are that it has a high energy density, high detonation velocity and it is suitable for use in wells. Because of the different wellbore diameters involved and hence explosive diameters, a liquid explosive has the desirable feature of being poured into a container of any shape and without special machining casting or packing. Of the liquid explosives available, nitromethane has all of the proper characteristics.

While metals can be used for a container, they can present a debris problem during well cleanout, maintenance and production. Plastic containers appear to be a better choice, since they can be bailed, drilled, or pumped with no difficulty. However, if utilied as a closed vessel under hydrostatic conditions the collapse strength would be very low. A plastic container with a wall thickness sufficient to withstand the pressures found in a well, sufficient to withstand for example, a hydrostatic head of aproimately 1800 feet to 2300 feet of water or cil, would not make this a very practical solution.

Figure 4:
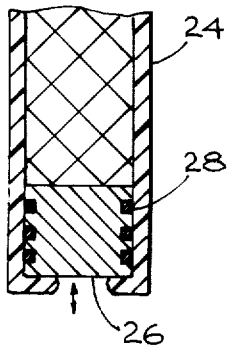
FIG. 4 is a cross section and fragmentary view of an explosive container.

However, as shown in FIG. 4, a plastic container having a sliding piston at one end whereby the liquid explosive is allowed to equalize to the surrounding fluid pressure is a practical solution to this problem. In FIG. 4, there is shown in cross-section one end of a plastic container 24, having a slidable piston 26 in the bottom therof. The O-rings 28 prevent leakage into or out of the plastic container. Tests show that the indicated liquid explosive can be detonated at typical working pressures obtained within the well.

There has accodingly been described herein a novel and useful method and means for stimulating a well by fracturing the rock at the pay zone with a high explosive and extneding the fractures by using a propellant.

The embodiments of the invention in which an exclusive property or privilege is claimed are defined as follows:

1. A method for fracturing the rock formation at a pay zone located at a predetermined depth in a well comprising filling said well above said pay zone with a fluid, closing siad well, above said pay zone, generating a pressure wave in said fluid at the region of said pay zone which has an amplitude and duration such that it can force said fluid into fractures which are created in the pay zone for extending these fractures, and generating a shock wave in said fluid during the interval of said pressure wave which has a rise time less than the time required for sound to tranverse one-half of the periphery of the well opening at said pay zone and in which when transmitted to said rock formation has an amplitude which will fracture but not crush said rock formation.

2. A method as recited in claim 1 including perforating the well casing in the region of the pay zone prior to generating said pressure wave.

3. A method for fracturing the rock formation at a pay zone located at a predeterminde depth in a well comprising filling said well above said pay zone with a fluid, suspending, within said fluid in said well at the region of said pay zone, a high explosive which when detonated creates a shock wave having a rise time which is less than the time required for sound to traverse one-half of the periphery of the well opening at said pay zone and which has an amplitude which will fracture but not crush the rock at said pay zone, suspending within said fluid in said well spaced from said high explosive a propellant which when ignited generates a pressure which can cause extension of fractures created by detonating said high explosive, closing said well immediately above the location of said propellant, igniting said propellant, and detonating said explosive during the time said propellant is deflagrating whereby fractures in the pay zone created by the detonation of said explosive are extended by the pressures generated by the deflagration of said propellant.

4. A method as recited in claim 3 wherein the spacing between high explosive and propellant is a function of the fluid required for filling the fractures to be created in said pay zone.

5. A method as recitd in claim 3 wherein said step of detonating said explosive includes sensing when the pressure in said fluid caused by the ignition of said propellant reaches a predetermined value, and detonating said high explosive in response to said sensing that said pressure has reached said predetermined value.

6. A method as recited in claim 3 wherein said explosive is cylindrically shaped and is suspended at the cneter of said pay zone, and the diameter of said explosive is chosen such that fracturing will occur without crushing the formation.

7. Means for fracturing the rock formation at a pay zone located at a predetermined depth in a well whereat the well casing, if any, has been perforated comprising means for filling said well above said pay zone with a fluid, means for closing said well, above said pay zone, means for generating a pressure wave in said fluid at the region of said pay zone which has an amplitude such that it can force said fluid into fractures created in the pay zone for extending these fractures, and means for generating a shock wave in said fluid during the interval of said pressure wave which has a rise time less than the time require for sound to traverse one-half of the periphery of the well opening at said pay zone and which when transmitted to said rock formation has an amplitude which will fracture but not crush said rock formation.

8. Means for fracturing the rock formation exposed at a pay zone located at a predetermined depth in a well comprising means for filling said well above said pay zone with a fluid, means for suspending, within said fluid in said well at the region of said pay zone, a high explosive which then detonated creates a shock wave having a rise time which is less than the time required for sound to traverse one-half of the periphery of the well opening at said pay zone and which has an amplitude which will fracture but not crush the rock at said pay zone, means for suspending a propellant within said fluid in said well spaced from said explosive which when ignited generates a pressure which can cause extension of fractures created by detonating said hight explosive, means for closing said well at the fluid level.

means for igniting said propellant, and means for detonating said explosive during the time said propellant is deflagrating whereby fractures in the pay zone created by the detonation of aid explosive are extended by the pressures generated by the deflagration of said propellant.

9. Means for fracturing rock formation exposed at a pay zone as recited in claim 8 wherein the distance between said propellant and said explosive is a function of the volume of fluid required to fill the fractures to be created into said pay zone.

10. The apparatus as recited in claim 8 wherein said high explosive is in the form of a cylinder suspended substantially centrally at said pay zone.

11. The apparatus as recited in claim 8 wherein said high explosive is a liquid and thereis included container means for containing said liquid, and means for equalizing the pressure inside siad container with the pressure on the surface of said container.

12. The apparatus as recited in claim 8 wherein said means for detonating said high explosive includes pressure sensing means for determining when the pressure at said high explosive reaches a predetermined value, and means responsive to said pressure sensing means sensing said predetermined value for detonating said high explosive.

* * * * *